US006218926B1

(12) United States Patent
May

(10) Patent No.: US 6,218,926 B1
(45) Date of Patent: Apr. 17, 2001

(54) REACTOR AND TRANSFORMER CORE ASSEMBLY

(75) Inventor: Scott Edwards May, Matthews, NC (US)

(73) Assignee: Square D Company, Palantine, IL (US)

( * ) Notice: Subject to any disclaimer, the term of this patent is extended or adjusted under 35 U.S.C. 154(b) by 0 days.

(21) Appl. No.: 09/219,923

(22) Filed: Dec. 22, 1998

(51) Int. Cl.[7] ..... H01F 27/26; H01F 27/30
(52) U.S. Cl. ..... 336/210; 336/196; 336/234
(58) Field of Search ..... 336/210, 196, 336/234

(56) References Cited

U.S. PATENT DOCUMENTS

| | | | | |
|---|---|---|---|---|
| 366,347 | * | 7/1887 | Sehmid | 336/210 |
| 366,375 | * | 7/1887 | Byllesby | 336/210 |
| 454,090 | * | 6/1891 | Thomson | 336/210 |
| 916,792 | * | 3/1909 | Selinger | 336/210 |
| 2,731,607 | * | 1/1956 | Gould et al. | 336/210 |
| 3,138,774 | * | 6/1964 | Derbyshire et al. | 336/210 |

* cited by examiner

*Primary Examiner*—Anh Mai
(74) *Attorney, Agent, or Firm*—David R. Stacey; Larry T. Shrout; Larry I. Golden

(57) ABSTRACT

A magnetic core assembly and method of assembling a magnetic core assembly. The core assembly includes laminated magnetic core tightly clamped together by a pair of unitized flanged clamps. Each unitized flanged clamp has a generally flat surface and a peripheral flange. The generally flat surface defines at least one opening for receiving a coil and a number of holes adjacent the opening for receiving assembly hardware. The core is assembled by placing a first one of the two unitized flanged clamps, flange down on a generally horizontal work surface. Alignment pins are placed in one or more of the assembly hardware apertures adjacent the coil opening. The segments of the first core lamination are slidably placed on the alignment pins such that they lie on the flat surface of the first unitized flange clamp. The segments of each remaining core lamination are slidably placed on the alignment pins until the required number of laminations have been installed. After the final lamination is installed, the second of the two unitized flanged clamps is placed on the final core lamination, flat surface down, the alignment pins are removed and assembly hardware is installed and tightened.

2 Claims, 6 Drawing Sheets

REACTOR AND TRANSFORMER CORE ASSEMBLY

FIELD OF THE INVENTION

The present invention relates to reactor and transformer cores and specifically to assembly of the laminated core.

BACKGROUND OF THE INVENTION

The construction of large reactor and transformer cores has been a time and labor intensive task due to the clamp fixturing, lamination alignment, temporary assembly, clamp welding and final assembly which has been required in the assembly process when assembling larger transformers in the 100 KVA to 5,000 KVA power range. The weight of the cores of these transformers ranges from 1000 pounds to more than 15,000 pounds and therefore requires an extremely strong clamp. The core laminations are supported and held in position by clamps, one on each side of the core. It has been the practice to make the clamp from sections of structural steel channel or a combination of structural steel channels and structural steel angles. Structural channels and angles are commercially available in standard sizes. The sizes of structural channels and angles selected for making the clamps are generally those with dimensions closest to the width of the core laminations. Therefore, the clamps provide little if any protection to the edges of the core laminations. The core assembly process starts by fixturing each channel section of the first clamp in proper position with respect to the other channel or angle sections of the clamp. The fixturing must be strong enough to maintain the respective positions of each channel or angle section of the clamp during the laying up of the core laminations. The flanges of channel sections are placed down in the fixture such that the core laminations can be laid on the flat surface of the clamp. Angle sections can be positioned such that flanges are either up or down. When channel and angles are used together, tie straps, which provide a means for alignment and attachment, are welded to each end of the channels. This is done as a subassembly process before core assembly is started. Alignment pins are placed in holes provided in the channels or angles for threaded fasteners used during final assembly of the core. The alignment pins are smooth and slightly smaller in diameter than the threaded fasteners used for final assembly. Each of the many lamination layers of the core consist of thin (5–15 mills thick) segments of magnetizable metal, each individually slidably placed on the alignment pins. Each lamination segment has mitered ends which must be positioned with respect to the adjacent mitered end of the other lamination segments of that layer and with respect to the position of the mitered ends of the previously laid lamination layer segments. After the final core laminations are placed on the stack, the channel and angle sections making up the second clamp are positioned on top of the core stack. A final alignment of the core laminations and clamps is completed and the core assembly is temporarily secured by strapping or banding placed around each leg of the core. Lifting eyes are attached to the clamps and the core assembly is lifted to the upright position. The alignment pins are removed and threaded fasteners installed and tightened. The core assembly is then moved to a welding station where the channel and/or angle sections forming each of the first and second clamps are welded together. After welding, the core assembly is moved to a final assembly area where the coil and various electrical connectors and brackets are installed. Assembling a reactor or transformer core by this method is extremely time consuming and labor intensive.

Therefore, it would be desirable to eliminate many of these steps to reduce time and labor cost.

SUMMARY OF THE INVENTION

The present invention provides a solution to the extensive clamp fixturing, lamination alignment, temporary assembly, clamp welding and final assembly steps that have been required in assembling large reactor and transformer cores. The present invention provides a single piece flanged clamp for each side of the laminated core. The flanged clamps are made from sheet or plate steel and can be easily manufactured by conventional sheet metal tooling methods or by computer numeric controlled (CNC) machines and industrial robots. The manufacturing process includes the steps of punching the coil window, the hardware assembly holes, lifting holes, coil bracket mounting holes and flange notches, forming the flanges and welding the corners of adjacent flanges. Manufacturing the flanged clamp from one piece of sheet or plate steel permits the width of the side legs, top leg, bottom leg and the depth of the flanges to be selectively controlled. This permits the side, top and bottom legs to extend out past the edges of the core laminations for better protection. Extending the flanges of the bottom legs provides a more stable platform for the core assembly and can include holes for permanent mounting of the core assembly. Since each flanged clamp is of one piece construction, no assembly fixturing is required. Using a one piece flanged clamp on each side of the core assembly improves the alignment of core laminations, which in turn results in better performance and reduced noise. Core construction is accomplished by placing the first flanged clamp on a generally flat surface such that the edges of the outwardly facing flanges are in contact with the generally flat surface. In this position, the generally flat surface of the flanged clamp forms a horizontal plane on which the core laminations are stacked. Alignment pins are then placed in the holes provided for final assembly fasteners, thus allowing the flanged clamp to serve as a fixture for laying up the core laminations. Each segment of the core lamination is slidably positioned on the alignment pins. After the desired number of laminations have been stacked on the first flanged clamp, the second flanged clamp is positioned on top of the core and the alignment pins are removed. Final assembly fasteners are then placed in the holes previously occupied by the alignment pins and tightened such that the two flanged clamps and the intermediate core laminations are tightly secured together. The core is then completely assembled and can be moved to the upright position for inserting the coil and making final wiring connections. The one piece flanged clamp and construction method of the present invention, as described above, can also be used in the construction of large liquid filled, wound core transformers.

DETAILED DESCRIPTION OF THE DRAWINGS

Figure 1:
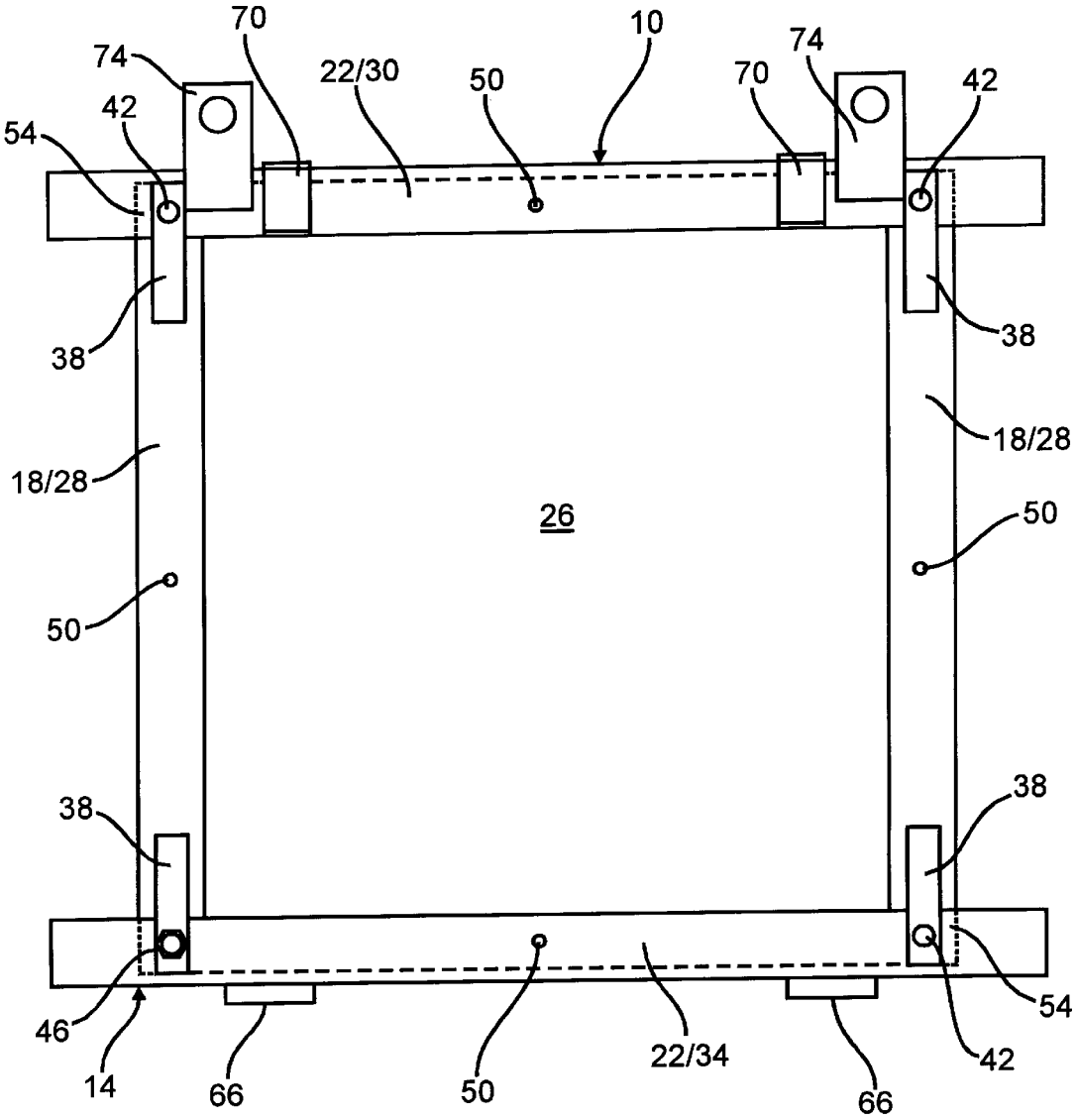
PRIOR ART Fig. 1
FIG. 1 a front view of a typical core assembly of the prior art.

FIG. 1 illustrates a core assembly generally indicated by reference numeral 10 of the prior art as used in larger transformers of the 100 KVA to 5,000 KVA power range. These core assemblies 10 range in weight from 1000 pounds to more than 15,000 pounds. Two clamp assemblies 14, constructed of a combination of structural channels 18 and structural angles 22 provide structural support and protection for the core assembly 10 and a coil (not shown) to be installed within a coil window 26 defined by the clamp assemblies 14. One clamp assembly 14 is placed on each side of the core assembly 10 during construction. The channels 18 form the generally vertical side legs 28 of each clamp assembly 14 and the angles 22 form the generally horizontal top 30 and bottom 34 of each clamp assembly 14. A tie strap 38 is welded to each end of each channel 18. Each tie strap 38 includes a hole 42 for receiving assembly hardware 46 such as a threaded rod and nuts, which are used during final assembly to secure the core assembly 10. Other assembly hardware holes 50 are provided in each channel 18 and each angle 22 for receiving assembly hardware 46 during final assembly.

Figure 2:
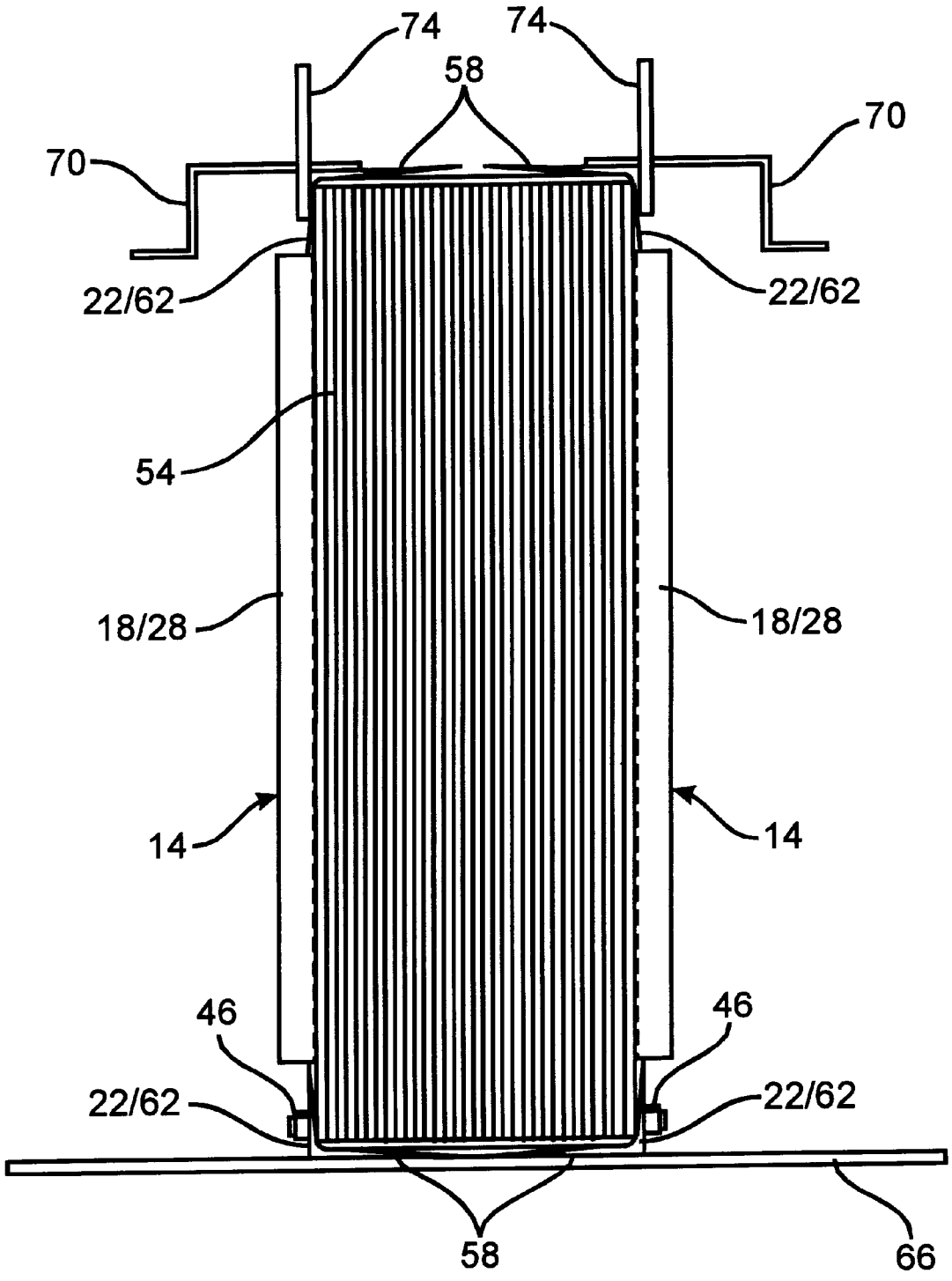
PRIOR ART Fig. 2
FIG. 2 a side view of a typical core assembly of the prior art.

Referring now to FIG. 2, it can be seen that a number of core laminations 54 are sandwiched between the two clamp assemblies 14. These core laminations 54 are supported and held in position by the two clamp assemblies 14. In this construction of the core assembly 10, flanges 58 of the angles 22 are turned inward over the core laminations 54, and flanges 62 of the angles 22 are generally parallel with the core laminations 54. This provides some protection for the core laminations but also makes for an unstable core assembly 10, since the ratio of the width of the core assembly 10 to the height of the core assembly 10 is small. Therefore, the core assembly 10 is susceptible to being tipped over. To prevent this from occurring and to provide a mounting bracket for the core assembly, one or more mounting feet 66 are provided. Each mounting foot 66 is welded to the bottom 34 of the two clamp assemblies 14 during final assembly. Z-shaped coil mounting brackets 70 and lifting pads 74 (best seen in FIG. 1) are welded to the top 30 of each clamp assembly 14 at final assembly or during a prior sub assembly operation.

Figure 3:
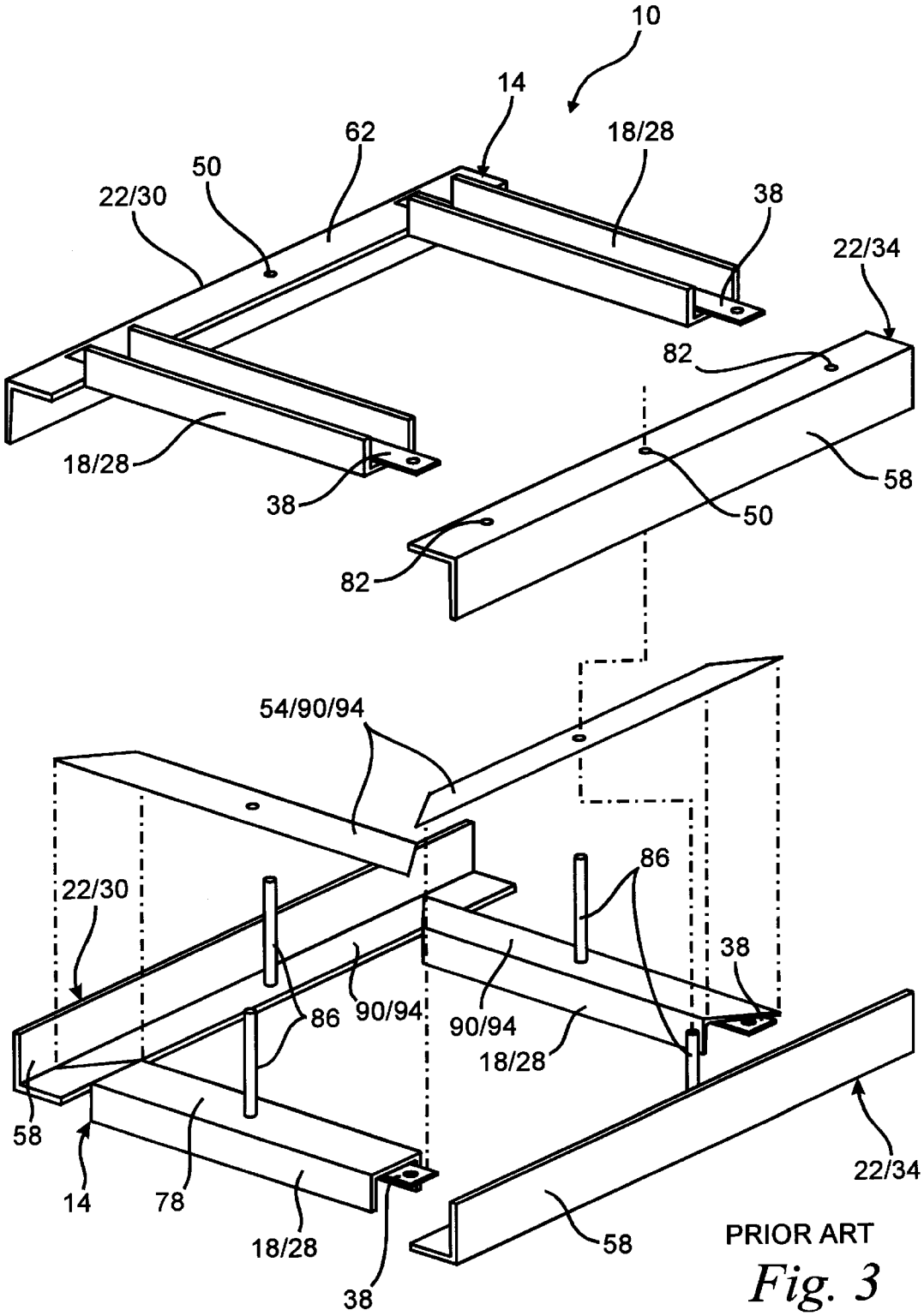
PRIOR ART Fig. 3
FIG. 3 is an exploded view of the core assembly of FIGS. 1 and 2.

Referring now to FIG. 3, the steps of assembling the core assembly 10 will be discussed in greater detail. The assembly process starts by securely fixturing each channel 18 and each the angle 22 of one of the two clamp assemblies 14 in its proper position with respect the other channel 18 and angle 22 of that clamp assembly 14. The fixturing means (not shown) must be strong enough to support the weight of the core assembly 10 and maintain the respective positions of each channel 18 and angle 22 of the clamp assembly 14 during the laying up of the core laminations 54. The channels 18 are placed in the fixture such that their generally flat surfaces 78 face upward. In this example the angles 22 are positioned such that normally horizontal flanges 58 extend upward and the normally vertical flanges 62 are generally parallel with the flat surfaces 78 of the channels 18. The holes 42 in the tie straps 38 are aligned with holes 82 in the angles 22 for general position alignment between the channels 18 and angles 22. After fixturing of the channels 18 and angles 22 has been completed, alignment pins 86 are placed in at least one of the assembly hardware holes 50 of each channel 18 and angle 22. The alignment pins 86 are smooth and slightly smaller in diameter than the threaded fasteners 46 used for final assembly. The core lamination 54 is made up of the many lamination layers 90 each having four thin (5–15 mills thick) lamination segments 94 of magnetizable metal. The first layer 90 of core laminations 54 is laid on the flat surfaces 78 of the channels 18 and the flanges 62 of the angles 22, one segment 94 at a time. Each lamination segment 94 has mitered ends 98 which must be positioned with respect to the adjacent mitered end 98 of the other lamination segments 94 of that layer 90 and with respect to the position of the mitered ends 98 of the previously laid lamination layer 90. After the final core lamination layer 90 is placed on the core lamination 54, the channel 18 and angle 22 making up the other of the two clamps 14 are positioned on top of the core lamination 54. After a final alignment of the core laminations 54 and clamps 14 is completed, the core assembly 10 is temporarily secured by strapping or banding placed around each leg of the core assembly 10. Lifting eyes 102 are attached to the clamps 14 and the core assembly 10 is lifted to the upright position. The alignment pins 86 are removed and threaded fasteners 46 installed and tightened. The core assembly 10 is then moved to a welding station where the channels 18 and angles 22 forming each of the two clamps 14 are welded together. After welding, the core assembly 10 is moved to a final assembly area where a coil and various electrical connectors and brackets such as the Z-shaped coil mounting brackets 70 and lifting pads 74 are installed.

Figure 4:
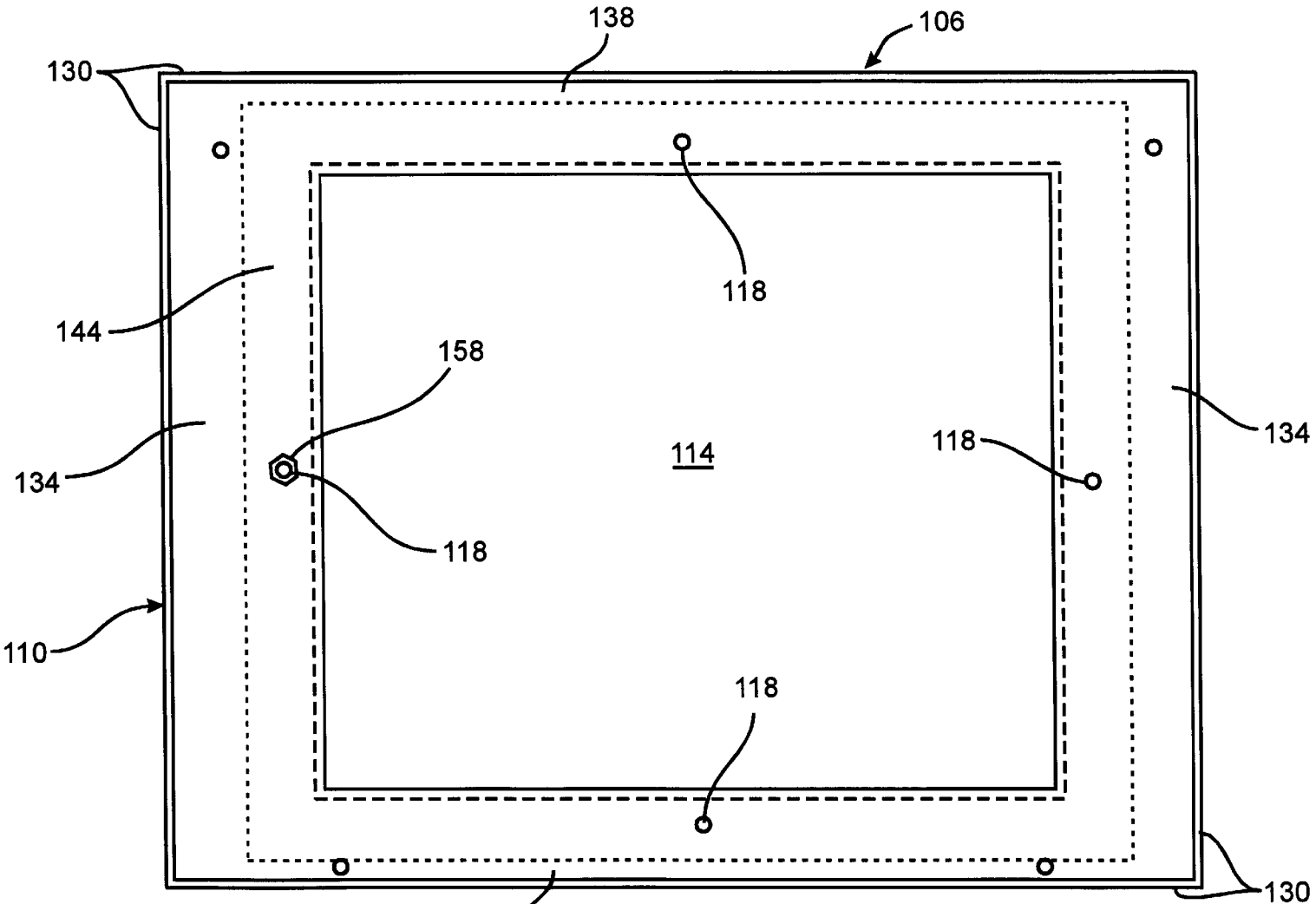
FIG. 4 is a front view of a core assembly constructed in accordance with the present invention.

Referring now to FIG. 4, the core assembly of the present invention is shown and generally indicated by reference numeral 106. A one piece flanged clamp 110 forms each side of the core assembly 106. The flanged clamps 110 are manufactured prior to starting the assembly of the core assembly 106. The flanged clamps 110 are manufactured from one sheet or plate of steel (unitized) and can be easily manufactured by conventional sheet metal tooling methods or by computer numeric controlled (CNC) machines and industrial robots. The manufacturing process for each flanged clamp 110 requires the steps of punching the coil window 114, hardware assembly holes 118, lifting holes 122 (see FIG. 5) and coil bracket mounting holes 126 (see FIG. 6); forming the peripheral flanges 130; and welding the comers of the adjacent flanges 130. Manufacturing the flanged clamp 110 from one piece of sheet or plate steel permits the width of the side legs 134, top leg 138 and bottom leg 142, and the depth of the flanges 130 to be selectively controlled. As can be observed when comparing the core assembly 106 of the present invention with the core assembly 10 of FIGS. 1–3, the wider side, top and bottom legs, 134, 138 and 142 respectively, provide better protection for the core laminations 144, shown in dotted lines in FIG. 4.

Figure 5:
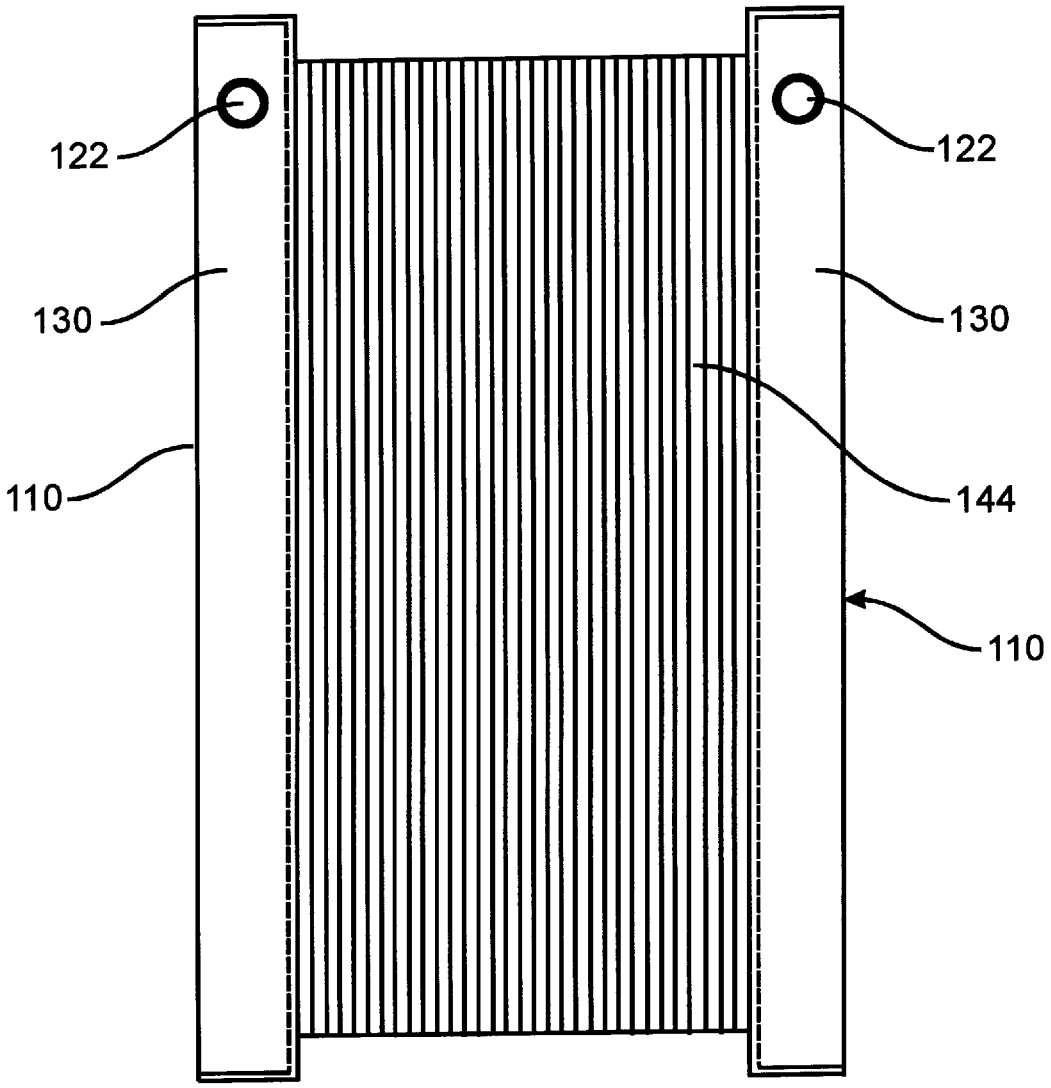
FIG. 5 is a side view of a core assembly constructed in accordance with the present invention.

Referring now to FIG. 5, an end view of the core assembly 106 is shown. Punching the lifting holes 122 in the flanges of the side legs 134 eliminates the need for a welding operation to add lifting eyes 102 of the prior art (see FIG. 1).

Figure 6:
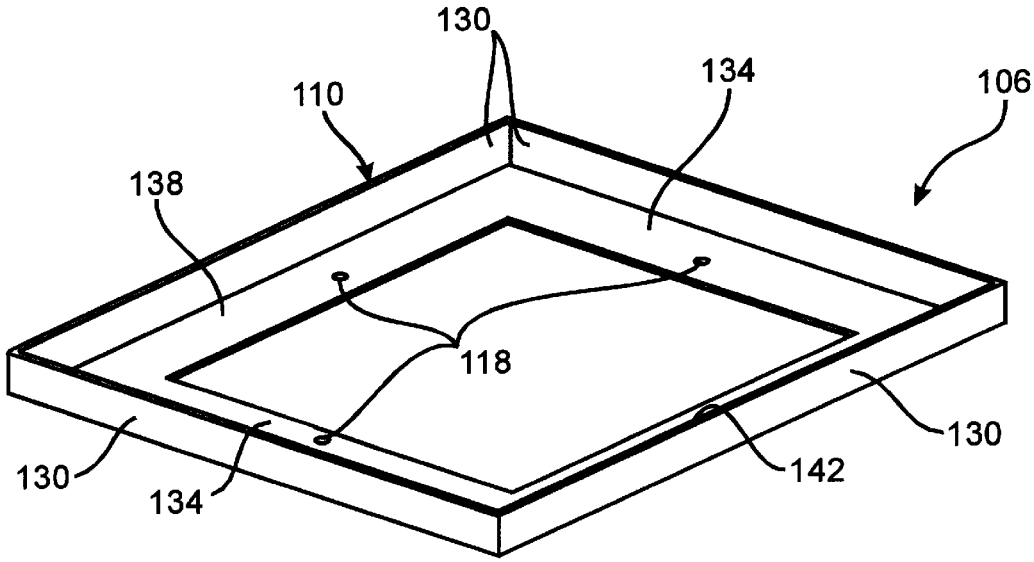
FIG. 6 is an exploded view of the core assembly of FIGS. 4 and 5. Before one embodiment of the invention is explained in detail, it is to be understood that the invention is not limited in its application to the details of construction in the description or as illustrated in the drawings. The invention is capable of other embodiments and of being practiced or being carried out in various other ways. Also, it is to be understood that the phraseology and terminology used herein is for the purpose of description and should not be regarded as limiting.
Figure 6:
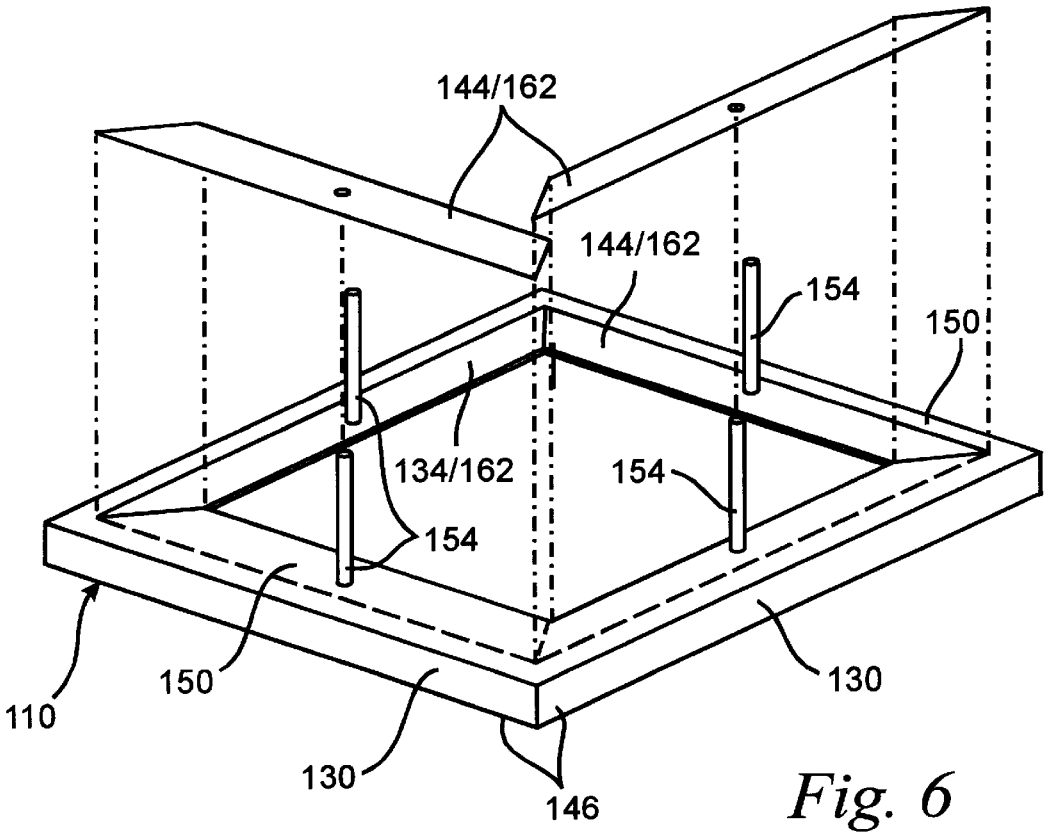

Referring now to FIG. 6, an exploded view of the core assembly 106 is shown. The manufacturing process of a core assembly 106 in accordance with the present invention will be described with respect to FIG. 6. Core assembly 106 construction is accomplished by placing one of the two flanged clamps 110 on a generally flat surface (an assembly platform, the floor, etc. not shown) such that the edges 146 of the outwardly facing flanges 130 are in contact with the generally flat surface. In this position, the generally flat surfaces 150 of the flanged clamp 110 forms a horizontal plane on which the core laminations 144 are stacked. Alignment pins 154 are then placed in the hardware assembly holes 118 provided for final assembly fasteners 158, thus allowing the flanged clamp 110 to serve as a fixture for laying up the core laminations 144. Each segment 162 of the core lamination 144 is slidably positioned on the alignment pins 154. After the desired number of laminations 144 have been stacked on the flanged clamp 110, the other of the two flanged clamps 110 is positioned on last core lamination 144 and the alignment pins 154 are removed. Final assembly fasteners 158 are then placed in the hardware assembly holes 118 previously occupied by the alignment pins 154 and tightened such that the two flanged clamps 110 and the intermediate core laminations 144 are tightly secured together. The core assembly 106 is then completely assembled and can be moved to the upright position for inserting a coil and making final wiring connections.

It is to be understood that magnetic core construction in accordance with the present invention can be used for both single and three phase cores. It is also within the scope of the invention to use the final assembly hardware 158 in place of the alignment pins 154 during assembly. Further, in some applications, alignment pins 154 are not required to maintain alignment of the core lamination segments 162 during assembly.

I claim:

1. A magnetic core assembly, said magnetic core assembly comprising:

a first unitized flanged clamp having a generally flat surface and a peripheral flange, said generally flat surface defining at least one opening for receiving a coil and a plurality of apertures adjacent said at least one opening for receiving assembly hardware;

a second unitized flanged clamp having a generally flat surface and a peripheral flange, said generally flat surface defining at least one opening for receiving a coil and a plurality of apertures adjacent said at least one opening for receiving assembly hardware, said first and second unitized flanged clamps being arranged such that said generally flat surfaces oppose one another;

a plurality of core laminations, each being in juxtaposed position with one another such that two generally planer outside surfaces are presented, said plurality of core lamination being intermediate said first and second unitized flanged clamps such that each of said two generally planer outside surfaces are in physical contact with one of said generally flat surfaces of said first and second unitized flanged clamps; and a plurality of assembly hardware passing through said apertures defined in said first unitized flanged clamp, said plurality of core laminations and said apertures defined in said second unitized flanged clamp, said plurality of assembly hardware providing means for tightly clamping and fixing said plurality of core laminations intermediate said first and second unitized flanged clamps.

2. A magnetic core assembly comprising:

a first flanged clamp having a generally flat surface and a peripheral flange;

a second flanged clamp having a generally flat surface and a peripheral flange, said first and second flanged clamps being arranged such that said generally flat surfaces oppose one another;

a plurality of core laminations, each being in juxtaposed position with one another such that two generally parallel and planer outside surfaces are presented, said plurality of core laminations being intermediate said first and second flanged clamps such that each of said two generally planer outside surfaces of said plurality of core laminations are in physical contact with one of said generally flat surfaces of said first and second flanged clamps; and a plurality of assembly hardware passing through apertures defined in said first clamped flange, said plurality of core laminations and said second flanged clamp, said plurality of assembly hardware providing means for a tightly clamping and fixing said plurality of core laminations intermediate said first and second flanged clamps.

* * * * *